United States Patent [19]

Horvath

[11] Patent Number: 4,540,339

[45] Date of Patent: Sep. 10, 1985

[54] ONE-PIECE HPTR BLADE SQUEALER TIP

[75] Inventor: Richard L. Horvath, Hamilton, Ohio

[73] Assignee: The United States of America as represented by the Secretary of the Air Force, Washington, D.C.

[21] Appl. No.: 616,380

[22] Filed: Jun. 1, 1984

[51] Int. Cl.[3] ..... F01D 5/20

[52] U.S. Cl. ..... 416/92; 416/97 R; 415/172 A

[58] Field of Search ..... 416/92, 97 R, 97 A, 416/96 R, 96 A; 415/172 A, 174

[56] References Cited

U.S. PATENT DOCUMENTS

| | | | |
|---|---|---|---|
| 2,613,058 | 10/1952 | Atkinson | 253/39 |
| 2,618,462 | 11/1952 | Kane | 253/39 |
| 2,823,894 | 2/1958 | Gerdan et al. | 253/39 |
| 3,574,482 | 4/1971 | Savage et al. | 416/90 |
| 3,626,568 | 12/1971 | Silverstein et al. | 29/156 |
| 3,719,365 | 3/1973 | Emmerson et al. | 277/53 |
| 3,781,129 | 12/1973 | Aspinwall | 416/97 |
| 3,834,001 | 10/1974 | Carroll et al. | 29/414 |
| 3,899,267 | 8/1975 | Dennis et al. | 416/92 |
| 3,982,851 | 10/1976 | Andersen et al. | 416/92 |
| 4,010,531 | 3/1977 | Andersen et al. | 29/156 |
| 4,073,599 | 2/1978 | Allen et al. | 416/97 |
| 4,142,824 | 3/1979 | Andersen | 416/97 R X |
| 4,232,995 | 11/1980 | Stalker et al. | 416/241 R X |
| 4,247,254 | 1/1981 | Zelahy | 415/172 A X |
| 4,390,320 | 6/1983 | Eiswerth | 416/97 R |
| 4,411,597 | 10/1983 | Koffel et al. | 416/97 A X |
| 4,487,550 | 12/1984 | Horvath et al. | 416/92 |

*Primary Examiner*—Everette A. Powell, Jr.

*Attorney, Agent, or Firm*—Donald J. Singer; Bobby D. Scearce

[57] ABSTRACT

An improved high pressure turbine rotor blade and tip cap structure therefor is provided which comprises a tip end closure for the blade bonded to the end wall of the blade casting and including a base plate member and a pair of upstanding side walls defining a peripheral contour coincidental with and faired to the cambered side walls of the casting, the base plate member having a plurality of radially outwardly opening passageways therethrough and disposed along the chord of the blade and communicating with a channel included in the radially outwardly facing surface of the casting along a chord of the blade, the passageways disposed along axes at angles to the base plate whereby coolant fluid flowing therethrough is directed against the tip side wall surfaces; and opening is provided through the end wall of the casting in the form of a slit or a plurality of holes along the chord of the blade and intersecting the channel, to define an outlet through the end wall for passage of coolant fluid through the blade.

3 Claims, 4 Drawing Figures

ONE-PIECE HPTR BLADE SQUEALER TIP

RIGHTS OF THE GOVERNMENT

The invention described herein may be manufactured and used by or for the Government of the United States for all governmental purposes without the payment of any royalty.

BACKGROUND OF THE INVENTION

This invention relates generally to rotor blades for turbine engines, and more particularly to improvements in tip cap configurations for hollow, high pressure, air cooled turbine rotor blades.

In the operation of a turbine engine, energy in the form of flow velocity of gaseous reaction products from the combustion chamber of the engine is used to drive the rotor of the turbine by passing the gaseous products against a plurality of turbine blades mounted on the turbine rotor and disposed in the path of the gaseous flow. The temperature of the gaseous combustion reaction products contacting the rotor blades of the turbine is ordinarily in excess of about 2500° F., and engine performance may be optimized in many applications by allowing a high operating temperature for the turbine inlet. In order to provide turbine rotor blades which can withstand these temperatures, it has been found desirable to provide hollow turbine blades which may be cooled by flowing air through the blades. To this end, existing turbine blade configurations have included hollow castings having internal air conducting chambers or passageways having suitable inlets and outlets through which coolant air may be passed. Existing methods for casting hollow rotor blades suitable for turbine blade application, however, ordinarily result in a cast blade which has an open tip end characteristic of the casting process. The blade thus must be provided with a suitable tip end closure to distribute air flow throughout the blade.

Existing tip cap configurations include the one-piece type as disclosed by or referenced in U.S. Pat. No. 3,899,267. This configuration comprises a one-piece tip cap having peripheral impingement cooling holes, and held in place mechanically by peripheral crimping of the blade tip and by brazing. This configuration provides suitable cooling to the blade and tip, but the crimping operation may be unreliable and may be characterized by an undesirably high fabrication reject rate. A two-piece cap configuration such as that described in U.S. Pat. No. 3,982,851 and U.S. Pat. No. 4,010,531 comprises two individual cap portions per blade which have peripheral impingement cooling holes, the cap portions being held in the rotor blade tip by retaining lugs in the blade casting and by brazing. The midchord area of the blade tip of this configuration may receive insufficient cooling which may result in severe distress in the tip area.

The present invention provides an improved rotor blade casting and rotor tip structure wherein the blade casting includes a channel along the chord of the blade and a slot or plurality of holes in the end of the casting through which the interior air flow chambers of the casting may communicate with the channel, and a tip bonded to the end of the casting and including a plurality of impingement holes in the tip base communicating with the channel and disposed at angles whereby coolant air flow may be directed against the upstanding side wall around the periphery of the tip. A high pressure turbine rotor blade fabricated according to the present invention is characterized by highly efficient cooling capability, minimal thermally induced low cycle fatigue, excellent oxidation resistance, low fabrication costs, and simplicity of manufacture and repair.

It is, accordingly, an object of the present invention to provide an improved turbine rotor blade.

It is a further object of the present invention to provide an efficient and economical tip cap closure for a hollow turbine rotor blade casting.

It is a further object of the invention to provide an improved turbine rotor blade having a tip cap including impingement air cooling on the tip periphery.

These and other objects of the present invention will become apparent as the detailed description of certain representative embodiments thereof proceeds.

SUMMARY OF THE INVENTION

In accordance with the foregoing principles and objects of the present invention, an improved high pressure turbine rotor blade and tip cap structure therefor is provided which comprises a tip end closure for the blade bonded to the end wall of the blade casting and including a base plate member and a pair of upstanding side walls defining a peripheral contour coincidental with and faired to the cambered side walls of the casting, the base plate member having a plurality of radially outwardly opening passageways therethrough and disposed along the chord of the blade and communicating with a channel included in the radially outwardly facing surface of the casting along a chord of the blade, the passageways disposed along axes at angles to the base plate whereby coolant fluid flowing therethrough is directed against the tip side wall surfaces; an opening is provided through the end wall of the casting in the form of a slit or a plurality of holes along the chord of the blade and intersecting the channel, to define an outlet through the end wall for passage of coolant fluid through the blade.

DESCRIPTION OF THE DRAWINGS

The present invention will be more clearly understood from the following detailed description of certain representative embodiments thereof read in conjunction with the accompanying drawings wherein.

DETAILED DESCRIPTION

Figure 1:
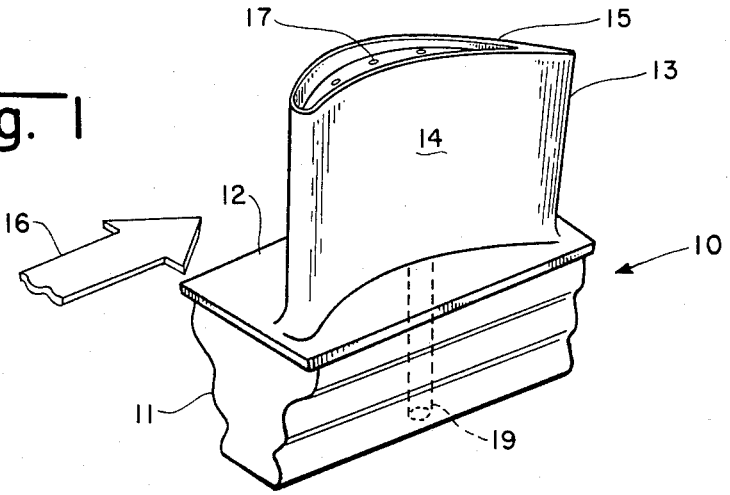
FIG. 1 is a perspective view of a turbine rotor blade of the type suitable for the incorporation of the invention herein.

Referring now to FIG. 1, shown therein is a perspective view of a typical hollow turbine rotor blade 10 of the type which may be suitable for the incorporation of the invention herein. Blade 10 may comprise a unitary casting including a dovetail 11 having tangs, fir tree or other keyed configuration for mounting within a matching slot on the periphery of the rotor (not shown) of the turbine, and a platform 2 supporting a hollow cambered air foil blade portion 13 presenting a pressure surface 14 and a suction surface 15 to the flow 16 of gaseous fuel combustion products represented schematically by the arrow. In conventional fashion, blade portion 13 may comprise a thin-walled shell including cambered sides 14,15 defining a plurality of interior chambers, and may include suitably placed blade holes 17 in the tip end thereof for the passage of coolant fluid, such as air, through the blade from an inlet port 19 provided in dovetail 11 and communicating with the interior chambers of blade 13.

Figure 2:
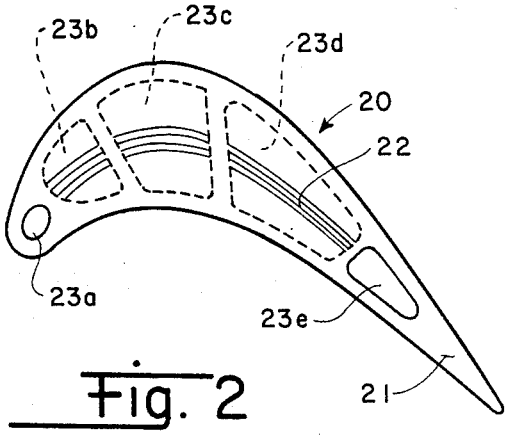
FIG. 2 is an end view of the cambered air foil portion of a hollow turbine blade casting.

Referring now to FIG. 2, shown therein is a view of the tip end of the cambered portion of a rotor blade 20 as cast to provide a blade similar to that of FIG. 1. The blade casting 20 may comprise any of the well known metals or alloys conventionally used in rotor blade construction, and may be cast using conventional casting techniques. The tip end of casting 20 may ordinarily be machined to present a substantially flat end surface 21 to which a tip cap may be attached as hereinafter described. In accordance with the present invention the blade casting 20 may be prepared to include near its radially outwardly facing end surface 21 a channel 22 to provide distribution of cooling air to the blade tip as hereafter described. Blade casting 20 may otherwise define a plurality of interior air flow chambers or plenums as represented in FIG. 2 as chambers 23*a–e* structurally communicating with an air flow inlet, such as designated as inlet 19 of FIG. 1.

Figure 3:
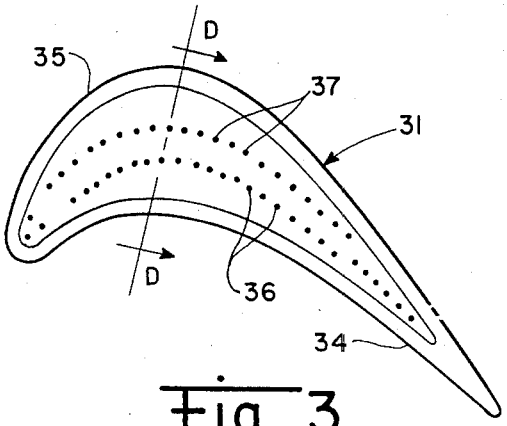
FIG. 3 is an end view of the cambered airfoil portion of a blade casting including the air impingment system of the invention.
Figure 4:
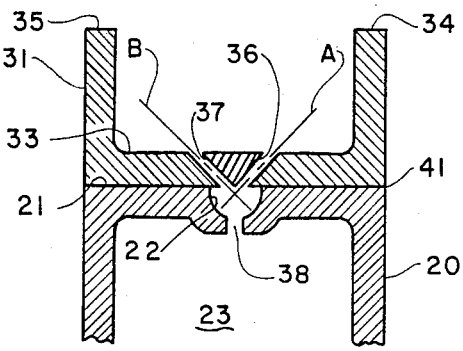
FIG. 4 is an end view of the blade of FIG. 3 with the tip structure of the present invention bonded thereto.

Referring now to FIGS. 3 and 4, a squealer/tip cap 31 is configured for attachment to the end surface 21. Although several processes for the attachment of tip 31 to casting 20 may be applicable, such as brazing, welding or the like, the process of activation diffusion bonding may be a preferred process. Accordingly, tip 31 will comprise a flat bottom plate portion 33 having a substantially flat surface machined to mate flush with end surface 21 of casting 20 at a bonding interface 41. Tip 31 will otherwise comprise a pair of radially outwardly extending (upward in FIG. 4) side wall members 34,35 of shape to conform to, fair with, and provide an extension of, the cambered surfaces of casting 20. Tip 31 may be cast or machined from any suitable metals or alloys bondable to the material selected for casting 20. Material selection for each of the casting 20 and tip 31 may be made to minimize low cycle fatigue damage, corrosion and oxidation of the completed blade during operation.

Tip 31 has a plurality of impingement holes 36,37 drilled or otherwise provided through bottom wall portion 33 along the length of tip 31 between walls 34,35 and along the contour of channel 22 in casting 20. Holes 36,37 are provided (e.g., drilled from the bottom side) along respective axes A,B disposed at angles as suggested in FIG. 4 to allow holes 36,37 to communicate with channel 22 in the assembled condition, and to intersect walls 34,35 as suggested in FIG. 4. In this configuration, air forced through holes 36,37 in a direction along axes A,B is directed against the surfaces of walls 34,35 to provide cooling around the entire internal periphery of side walls 34,35.

The cross-sectional configuration for channel 22 of casting 20 may preferably be that illustrated in FIG. 4, defining a central flow restrictor slot 38 intended to distribute air along channel 22 and to provide substantially similar flow rates through all the impingement holes 36,37. The restrictor slot 38 may preferably be sized in area so that if tip 31 should come off casting 20 during engine operation, sufficient cooling air will continue to flow through the interior blade chambers 23. Alternatively, slot 38 may be replaced with a series of holes along the length of channel 22 and through which channel 22 and chambers 23 may communicate. It is thus seen that the plurality of impingement holes 36,37 provided as just described distributes cooling air in a highly efficient manner to the rotor blade tip.

A high pressure turbine blade having a tip cap attached thereto according to the present invention may be fabricated as follows. A blade casting 20 and tip cap 31 are provided with the surfaces thereof comprising interface 41 machined flat for substantially flush surface mating. A thin layer of bonding agent, such as boronized foil (0.0015 inch thick) is then applied to the outer surface 21 of casting 20, and tip 31 is then joined thereto by high temperature activated diffusion bonding at about 2150° to about 2200° F., at about 40 psi to about 50 psi, depending on the selected material for blade casting and tip, to form the assembly suggested in FIGS. 3 and 4.

A rotor blade fabricated as just described is characterized by a highly reliable, low stress bonded joint between blade casting and tip. Further, the bonded assembly configuration of the present invention enjoys the distinct advantage over existing configurations in that a blade fabricated as disclosed herein has a single piece tip and may be easily repaired in the event of tip failure. For example, the tip of a damaged, out-of-specification or otherwise unacceptable rotor blade may be replaced simply by machining the unacceptable tip off to expose the casting (e.g., casting 20 of FIG. 2). A new tip cap 31 may then be applied according to the procedure just described to provide a high quality blade.

The present invention, as hereinabove described in certain representative embodiments thereof, therefore provides an improved tip end closure for a hollow cast turbine rotor blade. It is understood that certain modifications to the structure and assembly procedure for the tip end closure of this invention may be made as might occur to one with skill in the field of this invention, within the scope of the teachings. Therefore, all embodiments contemplated hereunder which achieve the objects of the invention have not been shown in complete detail. Other embodiments may be developed without departing from the spirit of the invention or from the scope of the appended claims.

We claim:

1. An improved rotor blade for a turbine engine which comprises:

a. a hollow casting including means for mounting said blade to the rotor of said turbine, and a cast end wall at the radially outward end thereof, said casting having cambered side walls defining an interior chamber having an inlet thereof near said mounting means;

b. a channel defined in the radially outwardly facing surface of said cast end wall and along a substantial portion of a chord of said blade, and an opening defined through said end wall and communicating with said channel, said opening comprising an outlet through said end wall for passage of coolant fluid through said blade;

c. a tip end closure for said blade bonded to said end wall of said casting, said tip end closure comprising a base plate member of peripheral contour coincidental with that of said cambered side walls and a pair of tip side walls faired with said cambered side walls, said base plate member bonded to and cooperating with said outwardly facing surface of said cast end wall to define a first passageway along said channel, said base plate member having a plurality of radially outwardly opening second passageways therethrough and disposed along the chord thereof and communicating with said first passageway, said second passageways defined along axes inclined to said base plate and intersecting said side walls whereby said coolant fluid flowing therethrough is directed against a surface of said tip side walls.

2. The rotor blade as recited in claim 1 wherein said opening comprises a slit through said cast end wall along substantially the entire length of said channel.

3. The rotor blade as recited in claim 1 further comprising a plurality of radially outwardly opening holes through said cast end wall and spaced along the length of and communicating with said first passageway.

* * * * *